US008016035B2

(12) United States Patent
Strattan et al.

(10) Patent No.: US 8,016,035 B2
(45) Date of Patent: Sep. 13, 2011

(54) CHEMICAL INJECTION CHECK VALVE INCORPORATED INTO A TUBING RETRIEVABLE SAFETY VALVE

(75) Inventors: Scott C. Strattan, Broken Arrow, OK (US); Jeffrey K. Adams, Broken Arrow, OK (US); Thomas S. Myerley, Broken Arrow, OK (US); Jason Ives, Broken Arrow, OK (US); Jeffrey C. Williams, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 1867 days.

(21) Appl. No.: 10/972,923

(22) Filed: Oct. 25, 2004

(65) Prior Publication Data

US 2005/0098210 A1 May 12, 2005

Related U.S. Application Data

(60) Provisional application No. 60/514,868, filed on Oct. 27, 2003.

(51) Int. Cl.
*E21B 47/10* (2006.01)
*E21B 34/06* (2006.01)
*E21B 41/02* (2006.01)

(52) U.S. Cl. ..... 166/250.08; 166/312; 166/324

(58) Field of Classification Search ..... 137/70, 137/512; 166/250.08, 300, 311, 312, 324, 166/332.1, 337, 336; 73/40.5 R, 49.5
See application file for complete search history.

(56) References Cited

U.S. PATENT DOCUMENTS

| | | | | | |
|---|---|---|---|---|---|
| 2,178,845 | A | * | 11/1939 | Baker | 137/70 |
| 3,331,378 | A | * | 7/1967 | Gibbs et al. | 137/68.17 |
| 3,347,039 | A | * | 10/1967 | Zeman | 137/70 |
| 3,437,142 | A | * | 4/1969 | Conover | 277/312 |
| 4,042,033 | A | | 8/1977 | Holland et al. | 166/310 |
| 4,182,159 | A | * | 1/1980 | Churchman | 73/40.5 R |
| 4,306,624 | A | * | 12/1981 | Bernard et al. | 166/336 |
| 4,399,871 | A | | 8/1983 | Adkins et al. | 166/325 |
| 4,562,854 | A | | 1/1986 | Pringle et al. | 137/155 |
| 4,565,215 | A | | 1/1986 | Cummings et al. | 137/538 |
| 5,004,007 | A | | 4/1991 | Johnson et al. | 137/501 |
| 5,718,289 | A | | 2/1998 | Schnatzmeyer et al. | 166/305.1 |
| 6,148,920 | A | | 11/2000 | McCalvin | 166/324 |

(Continued)

OTHER PUBLICATIONS

"Chemical Injection System: Optimize Flow Assurance through Chemistry Management" Well Dynamics, Flow Control: Transforming Reservoirs. Dec. 27, 2007: 2 pages. Retrieved Online on Jun. 24, 2008 from: http://www.welldynamics.com/pdfs/products/permanent_monitoring/Chemical_injection_System.pdf.

(Continued)

*Primary Examiner* — John Rivell
(74) *Attorney, Agent, or Firm* — Cantor Colburn LLP

(57) ABSTRACT

Disclosed herein is a safety valve with a chemical injection configuration. The device includes a hydraulic fluid pressure operated piston at the housing. The device further includes a flow tube in operable communication with the piston and a chemical injection configuration disposed within the housing. Further disclosed herein is a method of maintaining the operation of a safety valve by injecting chemical fluid through a configuration within the safety valve.

Still further disclosed herein is check valve. The check valve includes a seal, a dart having a closed head and sealable against the seal, one or more flutes on the dart, and a spring applying a biasing force to the dart to a sealing position, that force being overcomeable by a fluid pressure acting in a direction opposing the spring force.

10 Claims, 5 Drawing Sheets

U.S. PATENT DOCUMENTS

2004/0040718 A1 3/2004 Rhodes et al. ..... 166/325

OTHER PUBLICATIONS

"DCIN Dual-Check Chemical Injection Mandrel" www.slb.com/oilfield. Schlumberger, Dec. 2003: 2 pages. Retrieved online on Jun. 24, 2008 from http://www.slb.com/media/services/completion/accessories/tubing_mounted/dcin_dual_check.pdf.

Buning, B.C, et al. "Experimental Injection Set-Ups for Downhole Chemical Dosing," Proceedings World Geothermal Congress 2000: Kyushu-Tohoku, Japan, May 28-Jun. 10, 2000: 6 pages. Retrieved Online on Jun. 24, 2008 from: http://www.geothermie.de/egec-geothernet/techn_information/injection_technology/0492.PDF.

"MaxiMiser: Continuous Chemical Additive Injection System." Baker Hughes: Production Quest, Chemical Automation: Aug. 2007: 2 pages. Retrieved on Jun. 24, 2008 from: http://www.bakerhughesdirect.com/cgi/hello.cgi/PQ/public/productionquest/pdf/chemical_automation/pq07_13546_maximiser_techSheet.pdf.

Langston, Leslie L. "Special Information about Chemical Pumps," The Lease Pumper's Handbook, Appendix E, Section 1, Chemical Treatment, The Oklahoma Commission on Marginally Producing Oil and Gas Wells: First Edition 2003. 12 pages. Retrieved Online on Jun. 24, 2008 from: http://www.ok.gov/marginalwells/documents/D-Appendix%20E.pdf.

* cited by examiner

CHEMICAL INJECTION CHECK VALVE INCORPORATED INTO A TUBING RETRIEVABLE SAFETY VALVE

CROSS-REFERENCE TO RELATED APPLICATIONS

This application claims the benefit of an earlier filing date from U.S. Ser. No. 60/514,868 filed Oct. 27, 2003, the entire contents of which is incorporated herein by reference.

BACKGROUND

Chemical injection is often used in the downhole oilfield industry in conjunction with safety valves such as tubing retrievable safety valves because a common and relentless problem is a buildup of scale, hydrates, paraffin and other undesirable solids on downhole structures. Any one or combination of these solids collecting in a safety valve, i.e., on or around a flapper, on the torsion spring, on the flow tube, the power spring, etc., can hamper the ability of the safety valve to function at optimum. Chemicals, which are selected depending upon the chemistry of the wellbore and therefore the chemistry of the solids presenting problems, can be injected down into the downhole environment to dissolve such solids. In general, with respect to tubing retrievable and other safety valves in a traditionally accepted configuration, included at an uphole end thereof via common connections such as a premium thread, a secondary chemical injection device which is connected to a surface location for application of chemicals. Chemicals are injected from the location of the injection valve above the safety valve and are calculated to migrate to the areas of the safety valve. Clearly density, turbulence, obstruction and other issues may hamper the movement of the chemical to the safety valve. In addition the chemical often does not reach inner workings of the safety valve not directly exposed to the flow area thereof.

Chemical injection devices as described are expensive, cause spacing out issues and connection issues. In view of the ever increasing need for efficiency and cost effectiveness, the applicants herein have developed a new system which is more efficient, more effective, of lower cost, and beneficial to the art.

SUMMARY

Disclosed herein is a safety valve with a chemical injection configuration. The device includes a hydraulic fluid pressure operated piston at the housing. The device further includes a flow tube in operable communication with the piston and a chemical injection configuration disposed within the housing.

Further disclosed herein is a method of maintaining the operation of a safety valve by injecting chemical fluid through a configuration within the safety valve.

Still further disclosed herein is a check valve. The check valve includes a seal, a dart having a closed head and sealable against the seal, one or more flutes on the dart, and a spring applying a biasing force to the dart to a sealing position, that force being overcomeable by a fluid pressure acting in a direction opposing the spring force.

BRIEF DESCRIPTION OF THE DRAWINGS

Referring now to the drawings wherein like elements are numbered alike in the several Figures.

DETAILED DESCRIPTION

Figure 1:
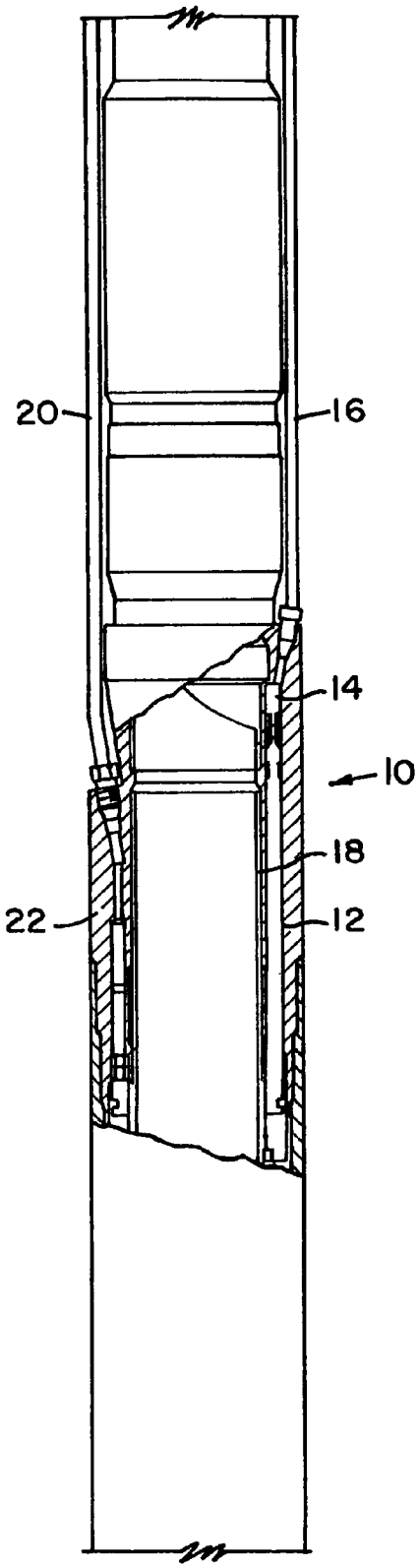
FIG. 1 is a partially cut-away view of a tubing retrievable safety valve having a chemical injection system provided therein.

Referring to FIG. 1, a break-away view of a tubing retrievable safety valve (TRSV), modified according to the disclosure is illustrated. The safety valve is generally indicated at 10. One of ordinary skill in the art should recognize piston 12, piston chamber 14, control line 16 and flow tube 18 as common components of a TRSV. A TRSV such as Baker Oil Tools part number H826103110. The balance of the components of the TRSV are considered known to the art and not in need of discussion or illustration. In accordance with the disclosure hereof TRSV body 22 is provided with a chemical injection configuration directly in the housing thereof. A greater disclosure of the configuration is made hereunder. Also illustrated in FIG. 1 is a secondary line 20 which is in fact a chemical injection line leading to a remote location, which may be a surface location or other downhole location, having access to a supply of chemical(s) for injection. As will be understood by one of ordinary skill in the art, different chemicals are utilized at different times for different reasons, each of which can be sent down the chemical injection line 20 as discussed further herein.

Figure 2:
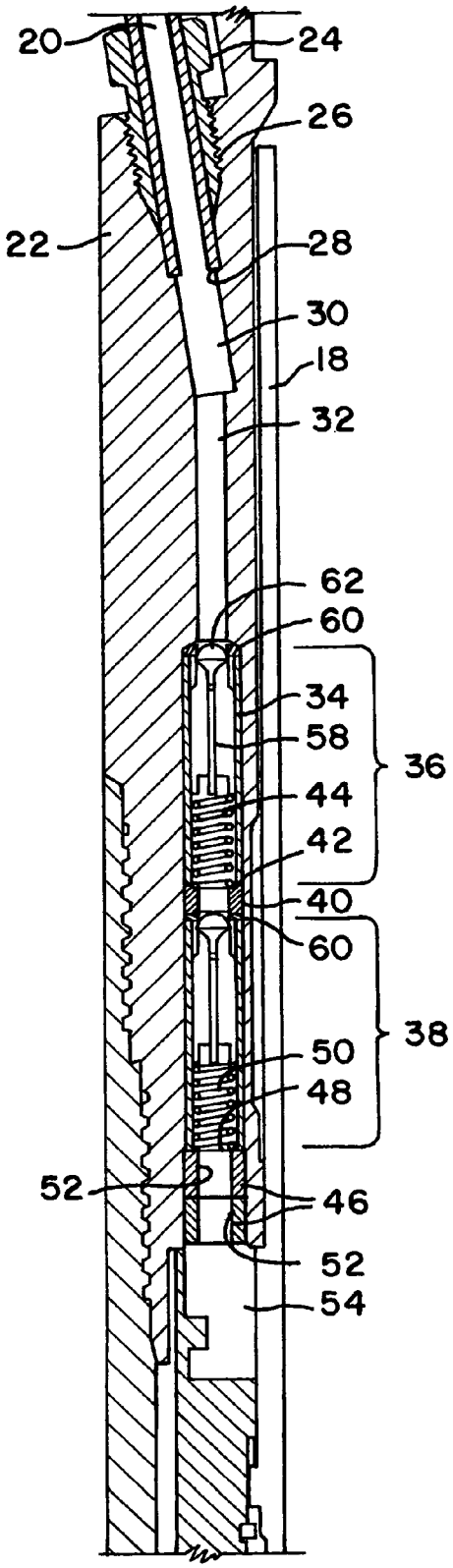
FIG. 2 is a cross-section expanded view of the left side of the cut-away portion in FIG. 1.

Referring now to FIG. 2, chemical injection line 20 is connected to body 22 by conventional means utilizing a control line nut 24 threaded into a tap section 26 in TRSV body 22. The control line 20 extends a short distance as illustrated below nut 24 to bottom on shoulder 28 of a smaller dimension conduit 30 leading to a channel 32. The interconnection between section 30 and 32 need merely provide for sufficient volume of chemical injected fluid to be acceptable. The channel 32 leads to a larger dimension channel 34 which is configured to receive two check valves 36 and 38 to prevent wellbore fluids from moving up the chemical control line. Between check valve 36 and 38 is spacer 40, which allows the check valves to operate properly since it provides a surface 42 against which the spring 44 of the first check valve 36 may bear and in addition provides space between surface 42 and the top of check valve 38 to avoid inhibition of fluid flow. The check valves are held in position by two nuts (in one embodiment) 46, one of which provides a seat 48 for spring 50 and the second of which simply locks the first nut 46. Both of the lock nuts are center drilled to create a tube 52 such that chemical injection fluid may pass therethrough and into chamber 54 whereafter the fluid will bleed in all directions around components of the safety valve. It is important to note that there are no seals between the housing 22, the flow tube 18, the power spring which is not shown herein but which is known to one of ordinary skill in the art, and other components of this device. One of the great advantages of the configuration as set forth herein is that the chemical injection fluid must flow through these parts in order to reach the inside dimension of the wellbore making it much more likely that the chemical injected fluid is going to reach all of the places that might otherwise have hydrate and other solid buildup. This is a significant advantage since it requires less chemical to be injected and will take less time for the chemical to reverse the solids deposition process that affected performance of the safety valve and gave rise to the need for treatment.

It is important to point out that during the creation of this device the inventors concluded that check valves common in chemical injection configurations would not function properly in this device. This is because all the chemical injection valves are created to be utilized in a larger bore which allows them to have a central flow channel. This is not possible in this case due to the restricted diameter which itself is due to the thickness of the housing 22. In order to make the device function as intended, the inventors hereof were required to design a new check valve that would allow sufficient flow to achieve the desired result while still functioning within a narrower conduit than prior art check valves.

Figure 4:
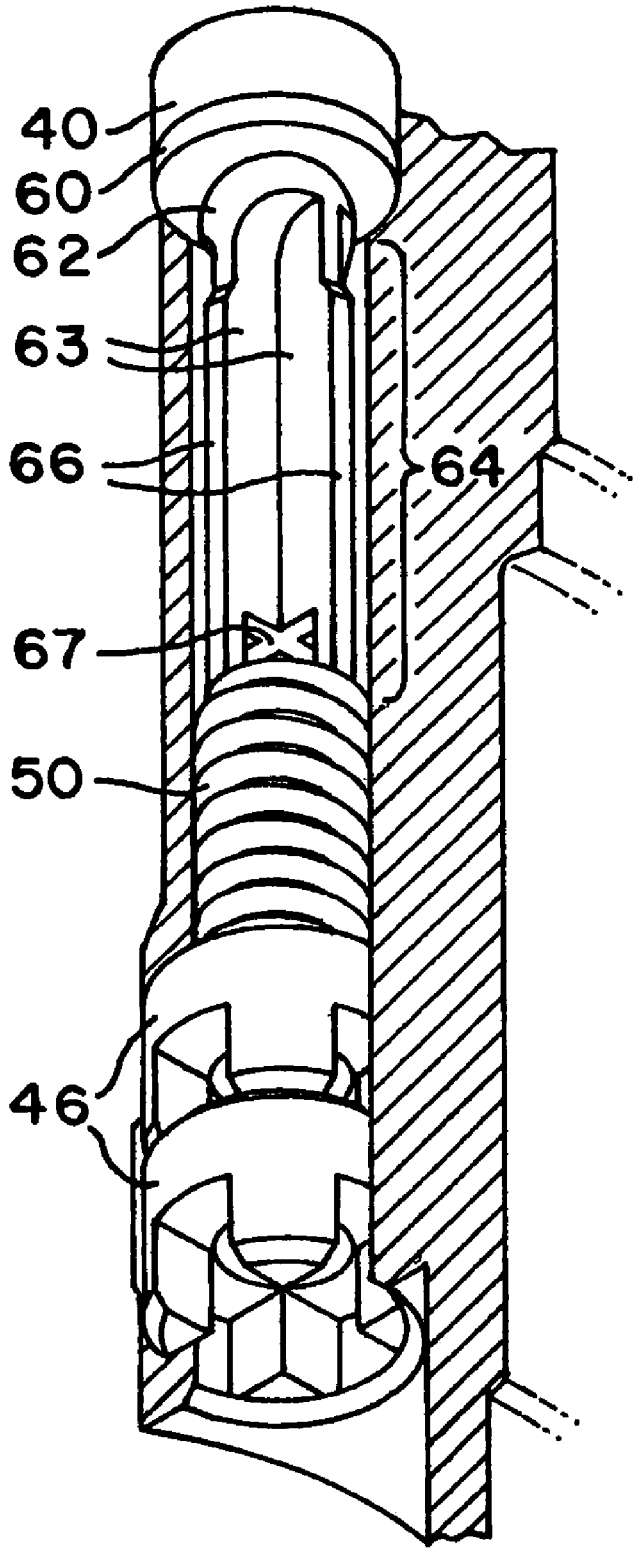
FIG. 4 is a perspective view of a check valve in accordance with this disclosure.

FIG. 2 provides an illustration of a cross-section of the valve itself and FIG. 4 should be viewed contemporaneously to provide perspective.

The check valve itself (see FIG. 4) comprises a seal 60 which in one embodiment is a PEEK seal ring which will interact with a dart head 62, which is in this embodiment a semi-spherical configuration. It is contemplated however that different shapes such as oval might be utilized. In the presently discussed embodiment, the semi-spherical head 62 is followed by one or more flow flutes 63 in a body portion 64. The machining or flutes, in one embodiment, is in 90 degree increments leaving a small amount of material identified herein as rib 66 between each of the flutes. It will be appreciated that a cross-section through body portion 64 in the described embodiment will yield a plus sign (+) or an X depending on orientation. It is contemplated that different configurations might be employed such as a rib cross-section of a Y-section and others. Also, although machining has been set forth above, the flutes may be formed differently such as by molding.

At the tail end of dart body 64 there is provided a recess 67 to provide a good flow area to the inside dimension of spring 50 44 which substantially reduces restriction in that area. The new check valve has been found to function well for its intended purpose and the TRSV as modified by the disclosure hereof will be more reliable for a longer period of working life.

Figure 3:
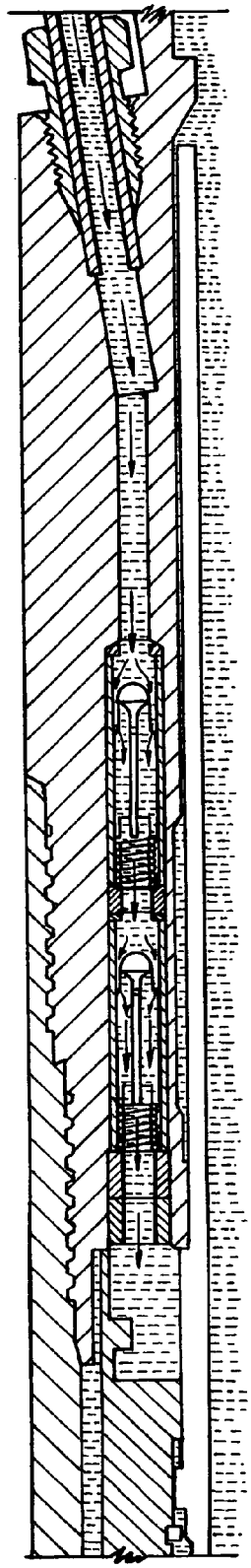
FIG. 3 is the same structure as that of FIG. 2 both in a position related to the injection of chemical to the safety valve.

Referring to FIG. 3, arrows are provided to show flow of the injected chemical and its action on check valves 36 and 38. As one will appreciate from this drawing, the pressurized fluid from the remote location moves into the configuration described to put pressure on head 62 of dart 58. Upon sufficient pressure being applied to head 62, spring 44 is compressed allowing fluid to flow past seal 60, around head 62 and into the flutes 63 of dart 58. This action is repeated at check valve 38 and the injected chemical is illustrated in chamber 54 and in all of the potential leak paths available to the chemical in the TRSV. Consideration should be given to the drafting method of illustrating the fluid in the cavity 54 and all the other places in this figure where that illustration method has been used. This is intended to indicate to the reader all of the leak paths of the chemical being injected.

In connection with the foregoing apparatus it is further desirable to allow for integrity testing of an umbilical leading to the safety valve. The device could be adapted to test lines other than chemical injection lines as well and so may be employed with other tools.

Figure 5:
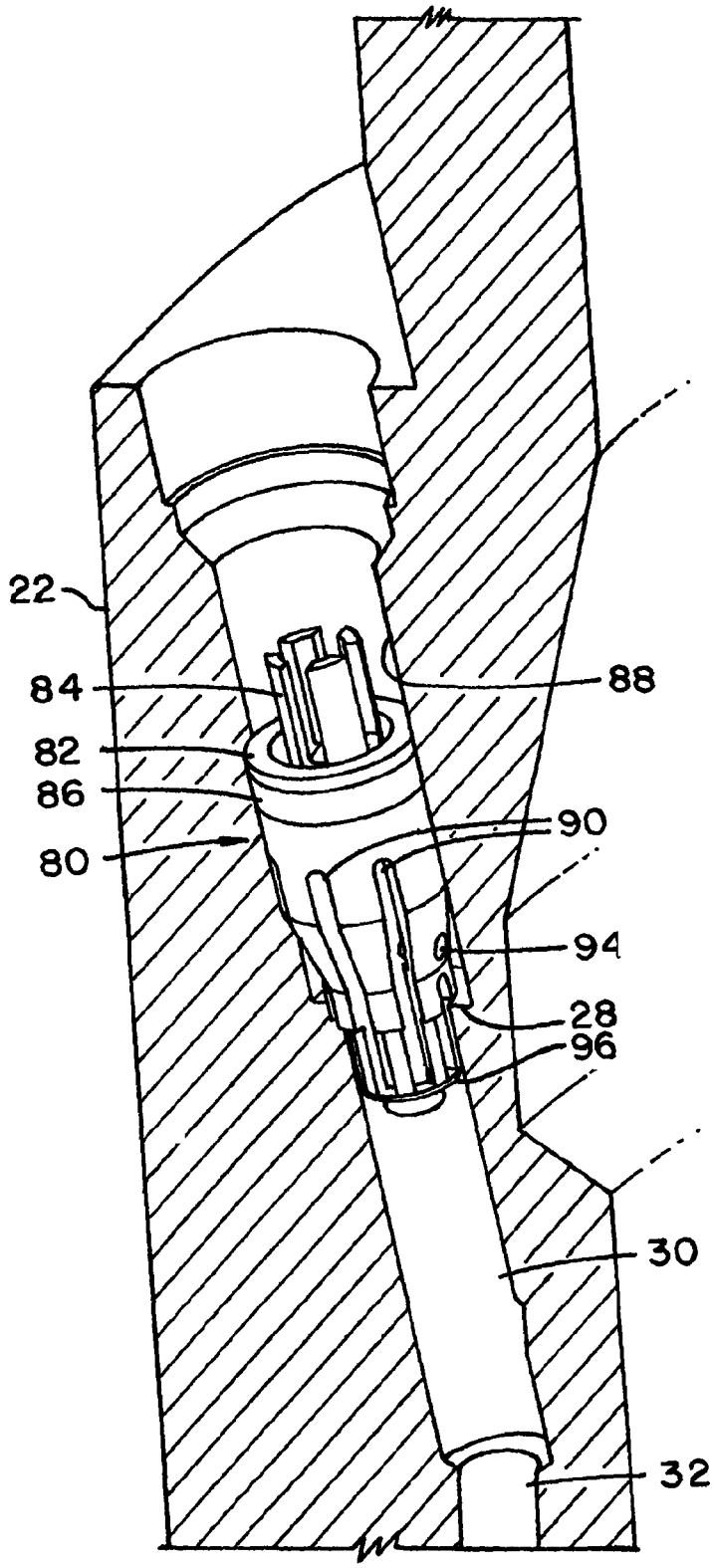
FIG. 5 is a perspective view of a pressure test assembly installed in a tubing retrievable safety valve.

Referring to FIG. 5, shoulder 28, conduit 30 and channel 32 will be recognized in TRSV body 22 from earlier introduced figures. FIG. 5 also illustrates a line pressure tester assembly 80. The assembly comprises a housing 82 and a cartridge 84. A seal 86 on the outside dimension of the housing 82 cooperates with the inside dimension of bore 88 preventing leakage around the assembly 80. Also visible in FIG. 5 are flow slots 90, which cooperate with flow grooves 92 (different numbers of these grooves are illustrated in different drawings and are alternatives juxtaposing strength and flow area) in cartridge 84 when the assembly is "open". In the FIG. 5 view the assembly is "closed". It is maintained in this position by a retainer 94, which in the illustrated embodiment is a shear pin extending through housing 82 and cartridge 84. The cartridge 84 is further prevented from moving uphole by a stop 96, which in the illustrated embodiment is a retaining ring. It will be understood that arrangements other than those illustrated for the retainer and stop are equally applicable such as but not limited to protuberances on cartridge 84 or restrictions in housing 82. Returning to the shear pin, it will be understood that other retaining means are employable whose properties include preventing relative motion between housing 82 and cartridge 84 until a selected force is applied whereupon the cartridge is movable relative to the housing. Retainer 94 allows for resetting of the assembly 80 by replacing the shear pin. Other embodiments of retainer 94 will desirably but not necessarily be resettable. The capability of resetting allows the device to be reused while it would have to be replaced if it was not resettable.

Figure 6:
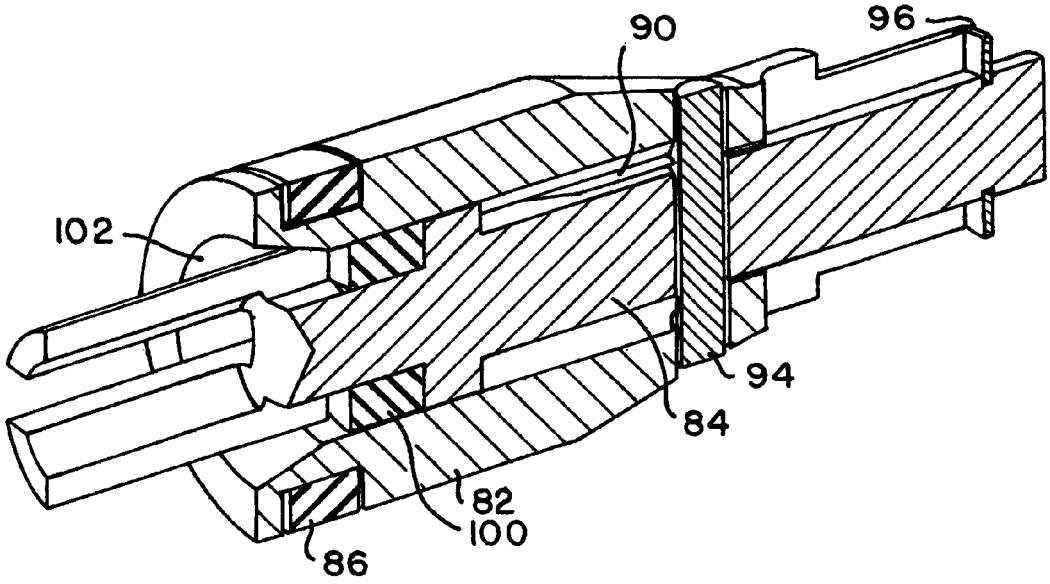
FIG. 6 is a cross-sectional view of the pressure test assembly before retainer override.
Figure 7:
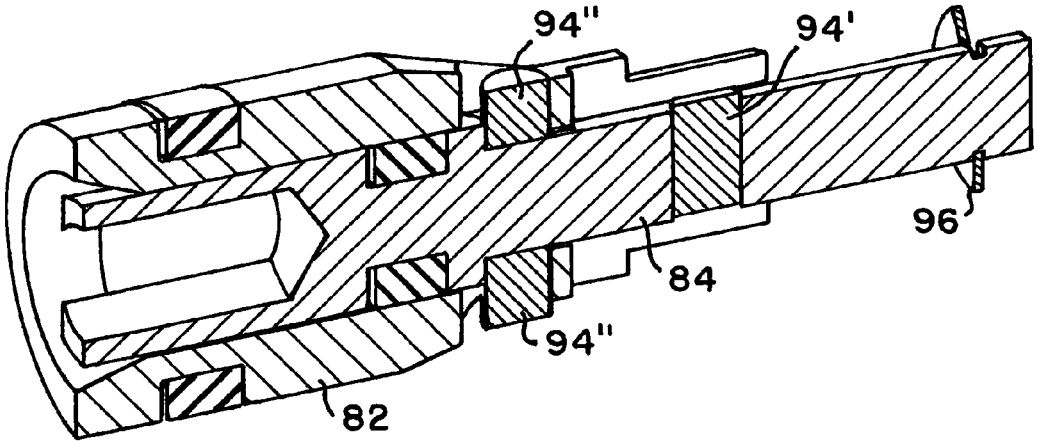
FIG. 7 is a cross-sectional view of the pressure test assembly after retainer override.

Referring to FIGS. 6 and 7, cross-sectional views of the assembly are illustrated to show position of the cartridge 84 in the housing 82 before and after shear, respectively. Upon exposure to these drawings one of ordinary skill in the art will immediately appreciate the relative movement between cartridge 84 and housing 82. Upon such movement in FIG. 6, one of the flow slots 90 can be seen. When seal 100 which is mounted on cartridge 84 and seals the cartridge 84 to the inside dimension 102 of housing 82, moves sufficiently downstream (right in picture) seal 100 allows fluid communication between grooves 92 and slots 90 for through passage of fluid. Seal 100 is in this moved position in FIG. 6 although slots 90 do not happen to be visible in the figure. It will be appreciated that the pin is double sheared and the center portion 94' moves downhole while the ends 94" stay in the position they hold prior to shearing.

In operation, the assembly is subjected to a first selected pressure to verify pressure competence of the injection system using this assembly and then to a condition calculated to override retainer 94, which may be a higher pressure.

While preferred embodiments have been shown and described, various modifications and substitutions may be made thereto without departing from the spirit and scope of the invention. Accordingly, it is to be understood that the present invention has been described by way of illustration and not limitation.

The invention claimed is:

1. A safety valve having a safety valve housing comprising:

a hydraulic fluid pressure operated piston at the safety valve housing;

a flow tube in operable communication with the piston; and a chemical injection configuration disposed within the safety valve housing configured to apply a chemical to an outside surface of the flow tube and the chemical injection configuration includes a fluid conduit and a pressure test assembly for the fluid conduit, the pressure test assembly includes:

a pressure housing having at least one opening for fluid flow and fluidly connected to the fluid conduit;

at least one check valve in fluid communication with the pressure housing; and a cartridge receivable and movably positionable within the pressure housing and located between the fluid conduit and the at least one check valve and having at least one opening for fluid flow, the cartridge being positioned to inhibit fluid communication between the fluid conduit and the at least one check valve until a pressure in the fluid conduit reaches a threshold pressure independent of a cracking pressure of the at least one check valve.

2. A safety valve as claimed in claim 1 wherein said at least one check valve comprises:

a dart having a closed head portion and a fluted body portion; and a spring in operable communication with the dart to urge the dart into sealing communication with a seal.

3. A safety valve as claimed in claim 1 wherein said safety valve includes two check valves.

4. A safety valve as claimed in claim 1 wherein said cartridge is repositionable to inhibit said communication after creating communication.

5. A method of maintaining the operation of a safety valve comprising:

pressure testing a fluid conduit by pressurizing the fluid in the conduit, the fluid being segregated from at least one check valve;

increasing pressure in the fluid conduit above a threshold pressure of a cartridge retainer to allow fluid communication with the at least one check valve; and injecting chemical fluid to the safety valve through the at least one check valve.

6. A method of maintaining the operation of a safety valve as claimed in claim 5 wherein said injecting includes applying pressure sufficient to unseat the at least one check valve within the safety valve.

7. A method of maintaining the operation of a safety valve as claimed in claim 5 wherein said injecting includes applying pressure sufficient to unseat at least two check valves within the safety valve.

8. A method of maintaining the operation of a safety valve as claimed in claim 5 wherein said retainer is a shear pin.

9. The safety valve as claimed in claim 1 wherein the pressure test assembly includes at least one stop to limit travel of the cartridge within the pressure housing.

10. The safety valve as claimed in claim 1 wherein the pressure test assembly includes at least one seal for sealing the cartridge to the pressure housing when the cartridge is in a position that inhibits fluid communication.

* * * * *